US005100349A

United States Patent [19]

Perkins et al.

[11] Patent Number: 5,100,349

[45] Date of Patent: Mar. 31, 1992

[54] JACK AND TRIM TRANSOM PLATE

[76] Inventors: Leroy G. Perkins, 1704 Tanglewood, Jonesboro, Ark. 72401; James R. Alexander, 238-240 Union St., Jonesboro, Ark. 72401

[21] Appl. No.: 625,121

[22] Filed: Dec. 10, 1990

[51] Int. Cl.[5] ..... B63H 21/26

[52] U.S. Cl. ..... 440/61; 248/641; 248/643

[58] Field of Search ..... 248/640, 641, 643; 440/58, 59, 60, 61

[56] References Cited

U.S. PATENT DOCUMENTS 4,482,330 11/1984 Cook ..... 440/61 X
4,624,438 11/1986 Goodman, Jr. ..... 440/61 X
4,778,415 10/1988 Knotts ..... 248/640 X

FOREIGN PATENT DOCUMENTS 139792 6/1987 Japan ..... 440/61

*Primary Examiner*—Sherman Basinger

*Attorney, Agent, or Firm*—Stephen D. Carver

[57] ABSTRACT

A transom plate for small fishing boats which simultaneously adjusts vertical displacement and trim of the outboard motor. The transom plate is adapted particularly for smaller fishing boats which must operate under widely varying loads and speeds, and which often encounter extremely shallow water. The plate comprises a rigid transom frame adapted to be clamped to the transom, and a motor bracket slidably movably coupled to the frame. Movement of the motor bracket relative to the transom frame is facilitated by a power cylinder preferably controlled from within the boat. The cylinder is pivotally coupled between the transom frame and the motor bracket, being secured and centered by L-brackets. Special follower slots are defined through each side of the jack to define a path of movement for displacement of the motor bracket relative to the transom frame. A generally vertically oriented slot is paired with a generally inclined follower slot on each side of the plate. Vertical displacement of the motor bracket results in simultaneous trimming of the motor.

7 Claims, 3 Drawing Sheets

JACK AND TRIM TRANSOM PLATE

BACKGROUND OF THE INVENTION

The present invention relates generally to transom mounts for coupling an outboard motor to a fishing boat. More specifically, our invention relates to a versatile transom jack designed for small fishing boats which is capable of simultaneously varying motor height and trim.

Transom mounts for mounting outboard motors to watercraft are well established in the art. Use of conventional transom mounts permits the user to selectively position the motor cavitation plate for improved efficiency of operation. In addition, transom mounts greatly facilitate trailering the boat. Transom mounts are advantageous to adapt a boat for varying loads and speeds. For example, the operator may position the cavitation plate lower in the water to obtain maximum thrust at low speeds when the boat is used for towing or other work, and subsequently raise the plate for operation at higher speeds. Correct location of the cavitation plate relative to the bottom of the boat is critical, particularly with small fishing boats.

Fishing boats typically include a rear transom for mounting the motor, angled at approximately eighteen degrees relative to the perpendicular. When a motor is mounted to the transom, it too will be oriented at substantially eighteen degrees, and its operative parts must be designed properly to dispose them in proper orientation. Improper orientation of the propeller, given the speed selected, for example, can lead to cavitation. However, the best disposition for the propeller and the best angle of orientation of the cavitation plate are functions of speed, boat weighting or load, and the depth of the water. Where a small, heavily loaded boat is traversing shallow water, for example, the motor must be raised to prevent the propeller from slamming into the bottom.

However, when a fishing motor is raised to "clear" for shallow depths, the orientation of the prop and the cavitation plate should be readjusted to angle the boat for proper planing and optimum thrust. In other words, the orientation of the prop's axis of rotation and the cavitation plate must be adjusted as a function of motor height.

It is also desirable to control the trim or angular orientation of the plate relative to the bottom of the boat. When the plate is angled into the water, for example, the propeller "digs" into the water and produces a greater thrust moment. At higher speeds, less angle is desired so that the cavitation plate provides minimum resistance. As will be appreciated by those experienced in the operation of small watercraft, vertical and angular motor relationships are closely interrelated. Maximum operating efficiency and comfort can only be achieved by proper adjustment of both, to achieve the desired combination of thrust and speed.

A variety of transom mounts directed to controlling the trim and/or height of outboard motors have been proposed in the prior art. For example, U.S. Pat. No. 4,778,417 issued to Mixon, Jr. on Oct. 18, 1988 discloses a transom bracket coupled to the boat by a pair of hydraulic cylinders which raise and lower the bracket. An additional cylinder is coupled to the motor head to adjust the motor tilt. Blanchard U.S. Pat. No. 4,504,237 issued Mar. 12, 1985 defines an outboard motor mount having hydraulically controlled swivel brackets for positioning the motor. In the latter device, tilt is controlled by cooperation of a pivot arm movable within follower slots associated with opposite sides of the mount. A fine trim adjustment mechanism is proposed for use in conjunction with a manually tiltable motor mount by MacGregor, in U.S. Pat. No. 4,682,959, issued July 28, 1987. A plurality of hydraulic cylinders provide tilt and trim adjustment in a transom mount adaptor proposed by Peirce in U.S. Pat. No. 4,687,448, issued Aug. 18, 1987. Prior art transom mount patents which are believed of greatest relevance to the present invention are the following: U.S. Pat. No. 4,778,415, issued Oct. 18, 1988 to Knotts; Cook, U.S. Pat. No. 4,482,330, issued Nov. 13, 1984; and, U.S. Pat. No. 4,624,438 issued to Goodman, Jr. on Nov. 25, 1986.

Knotts proposes a transom bracket which permits the operator to selectively control motor trim by activating hydraulic cylinders which displace the motor mount vertically relative to the transom mount. Motor height is controlled by separately operable pivot brackets. Cook provides a mount comprising a motor bracket slidably coupled to a transom bracket. Vertical displacement of the motor is limited by opposing pairs of follower slots defined parallel to the longitudinal axis of the transom bracket. A single hydraulic cylinder disposed within the interior of the mount controls movement of the motor via a remote control positioned within the boat. The outboard transom mounting defined in the latter Goodman '438 reference comprises a pair of motor brackets slidably coupled to a pair of transom brackets. Cooperating pairs of elongated follower slots defined longitudinally through the sides of the transom brackets limit vertical travel of the motor brackets relative to the boat. Movement of the motor brackets is controlled by winding and unwinding a ratchet-controlled cable associated with the motor bracket.

However, the known prior art does not disclose a transom mount which provides convenient means for simultaneously controlling both trim and vertical displacement of the motor. Thus it would seem desirable to provide a transom mount for small watercraft which conveniently adjusts both in a coordinated movement to maintain maximum operating efficiency and comfort in a wide variety of orientations.

SUMMARY OF THE INVENTION

Our invention comprises a transom plate which simultaneously adjusts both the vertical displacement and the trim angle of an outboard motor to achieve maximum operating efficiency and comfort. The transom plate is adapted particularly for smaller fishing boats.

Our transom plate preferably comprises a rigid transom frame adapted to be clamped to the transom of a small boat, and a motor bracket movably coupled to the frame. Movement of the motor bracket relative to the transom frame is facilitated by a power cylinder preferably controlled from within the boat. The cylinder is preferably pivotally coupled to the transom frame and the motor bracket.

Guide means comprising special follower slots are defined through each side of the plate to define a path of movement for displacement of the motor bracket relative to the transom frame. Vertical displacement of the motor bracket results in a coordinated angular displacement caused by the follower slots. A generally vertically oriented slot is paired with a generally inclined follower slot on each side of the plate. As the motor bracket travels upwardly along the path, trim is simultaneously adjusted. As the motor is lowered in the water for lower-speed operation, the cavitation plate is inclined relative to the bottom of the boat to provide increased thrust. When the motor is raised for higher-speed travel, the cavitation plate is raised to a generally horizontal position, generally parallel to the bottom of the boat.

Thus it is a broad object of our invention to provide a transom plate for mounting an outboard motor to a small watercraft.

Another basic object of our invention is to provide a transom plate for automatically adjusting motor height and trim.

A related object of the present invention is to provide a transom mount which can be conveniently manipulated to simultaneously adjust both motor height and trim.

Still another object of the present invention is to provide a transom plate which may be conveniently adjusted from within the boat while underway.

Another object of the present invention is to provide an efficient and better shallow-water drive system.

Yet another object of the present invention is to provide a transom plate which can be automatically adjusted to maximize operating efficiency and comfort.

A further object of the present invention is to provide a transom plate of the character described which may be mounted on small watercraft and used for a variety of purposes.

Still another object of the present invention is to provide a transom plate of the character described which facilitates improved safety and control during trailer loading especially in shallow water.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

1. Primary Embodiment

Figure 1:
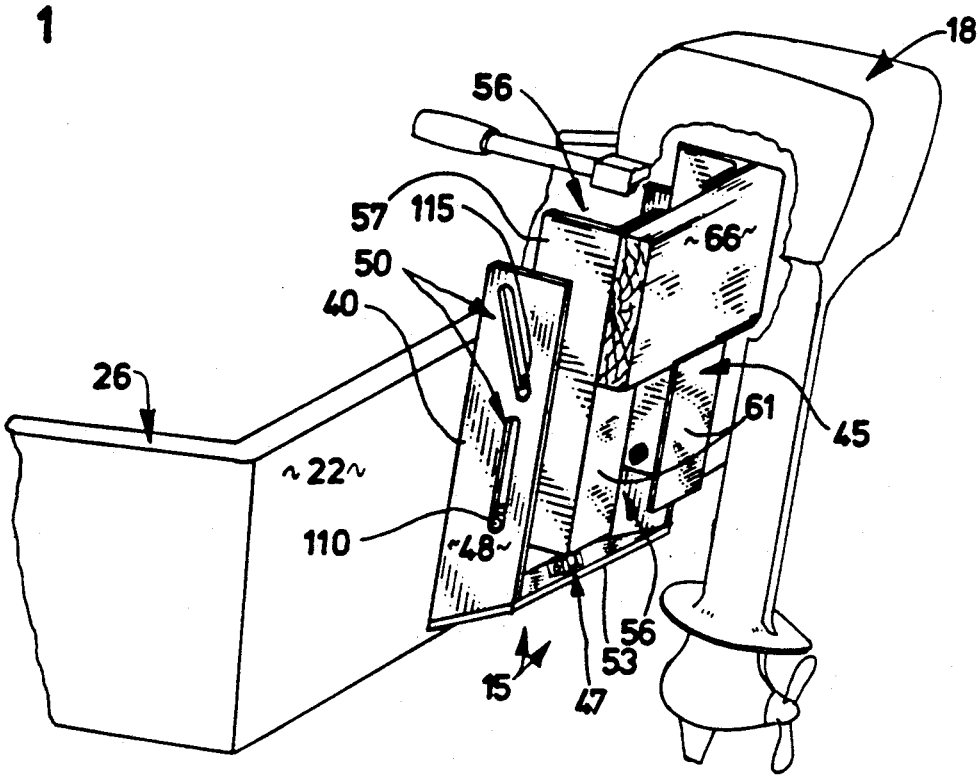
FIG. 1 is a pictorial view illustrating the best mode of our new Jack and Trim Transom Plate mounted upon a small fishing boat for controlling a conventional outboard motor, wherein portions are omitted for brevity or broken away or shown in section for clarity.

With initial reference to FIGS. 1-5 of the accompanying drawings, the first mode of our new jack and trim transom plate is broadly designated by the reference numeral 15. Plate 15 is used for coupling an outboard motor 18 to the transom 22 of a small craft such as a fishing boat 26. In operation, the plate facilitates automatic adjustment of the motor height and trim of the motor 18 relative to the bottom 31 of the boat 26.

Plate 15 comprises a rigid transom frame broadly designated by the reference numeral 40, and a movable motor bracket broadly designated by the reference numeral 45. Displacement of the motor bracket 45 with respect to the transom frame 40 is effectuated by an actuator assembly broadly designated by the reference numeral 47. Angular orientation of the motor during movement is controlled by guide means broadly designated by the reference numeral 50.

Figure 3:
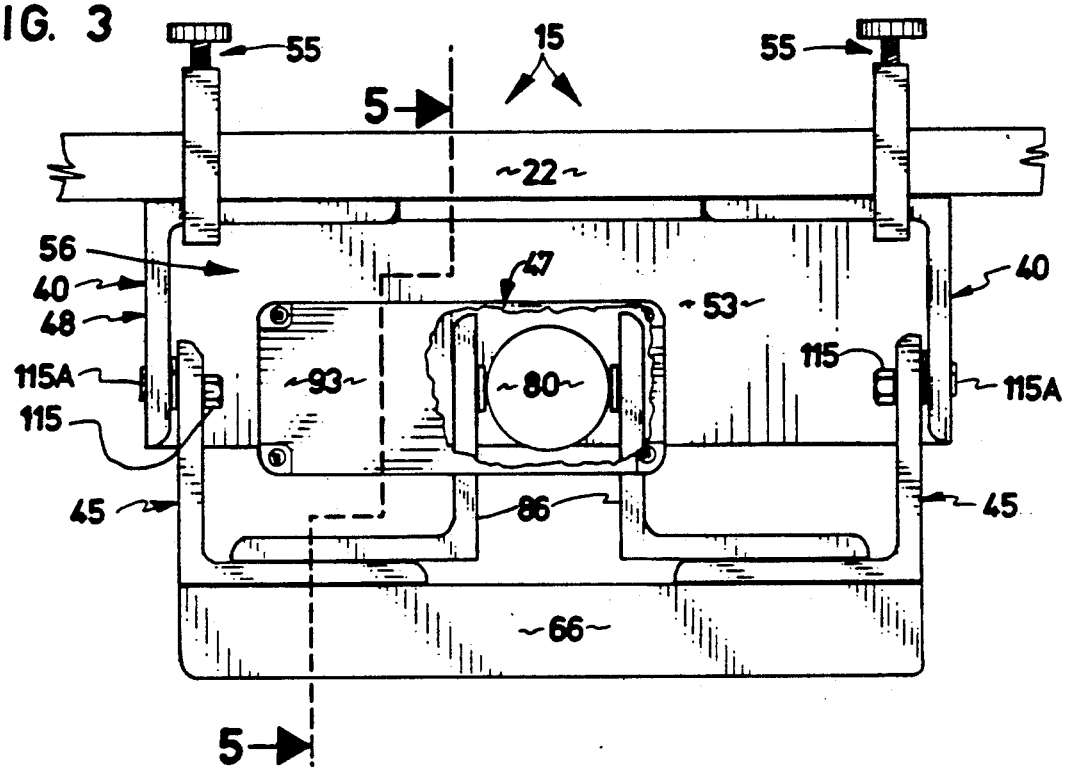
FIG. 3 is a top elevational view thereof, in which portions are broken away for clarity.
Figure 5:
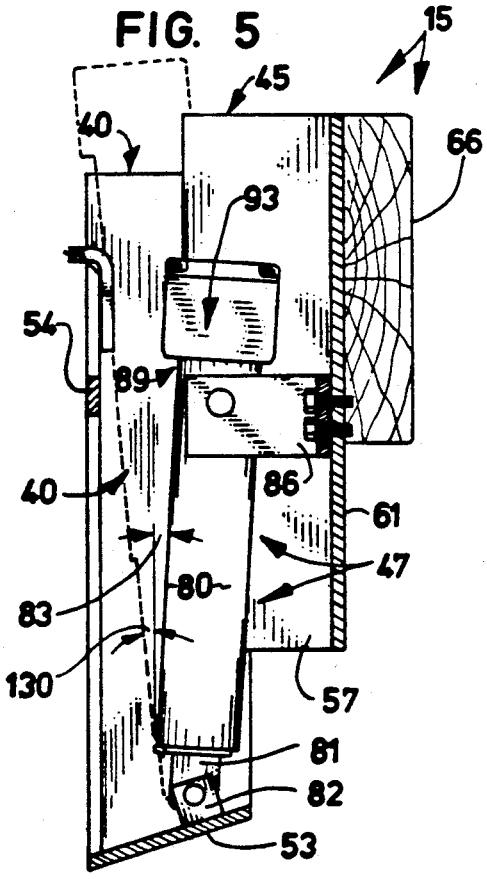
FIG. 5 is a reduced-scale, fragmentary sectional view taken generally along line 5—5 of FIG. 3.

With specific reference to FIGS. 1 and 3, the transom jack frame 40 comprises a pair of parallel side walls 48 spaced apart by a rigid, integral base 53 and a rigid supportive crossmember 54 (FIG. 5). Preferably a pair of conventional thumbscrew clamps 55 couple transom jack frame 40 to the boat transom 22. Preferably the transom jack frame will also be secured to the boat transom by bolts or the like. Walls 48 and base 53 define an open interior 56 which receives the motor bracket 45 and actuator assembly 47.

Motor bracket 45 comprises a pair of rigid, spaced-apart sides 57, each side 57 integral with a planar face 61. A rigid motor clamping plate 66, preferably comprising a finished board, is coupled to bracket 45 and secured by bolts or the like to faces 61. Motor 18 is clamped to plate 66 in the conventional manner. Bracket 45 is dynamically coupled to frame walls 48 for displacement within frame 40 responsive to selective engagement of the actuator assembly.

As best viewed in FIGS. 3 and 5, the actuator assembly 47 comprises a power cylinder 80, such as an electric cylinder, and conventional power controls preferably positioned within the boat (not shown). Cylinder 80 is preferably pivotally interconnected between the transom frame 40 and the motor bracket 45. Disposed thus within the interior of the plate 15, cylinder 80 is generally shielded from interference and damaging impacts.

At its lower end 81, cylinder 80 is pivotally coupled to a rigid bracket 82 integral with frame base 53 (FIGS. 1, 5). The upper end 89 of cylinder 80 is pivotally coupled to the motor bracket 45 by a pair of rigid L-shaped braces 86 (FIG. 3). As the cylinder is selectively extended or retracted, braces 86 draw the motor bracket upward or downward.

Cylinder 80 terminates at its upper end 89 in electric drive system 93. By manipulating controls conveniently positioned within the boat, the operator may activate the cylinder to effectuate desired changes in the height and orientation of the motor. As the motor bracket 45 is vertically displaced relative to the transom frame 40, trim is simultaneously adjusted. Movement of the motor bracket is controlled by guide means 50.

Figure 2:
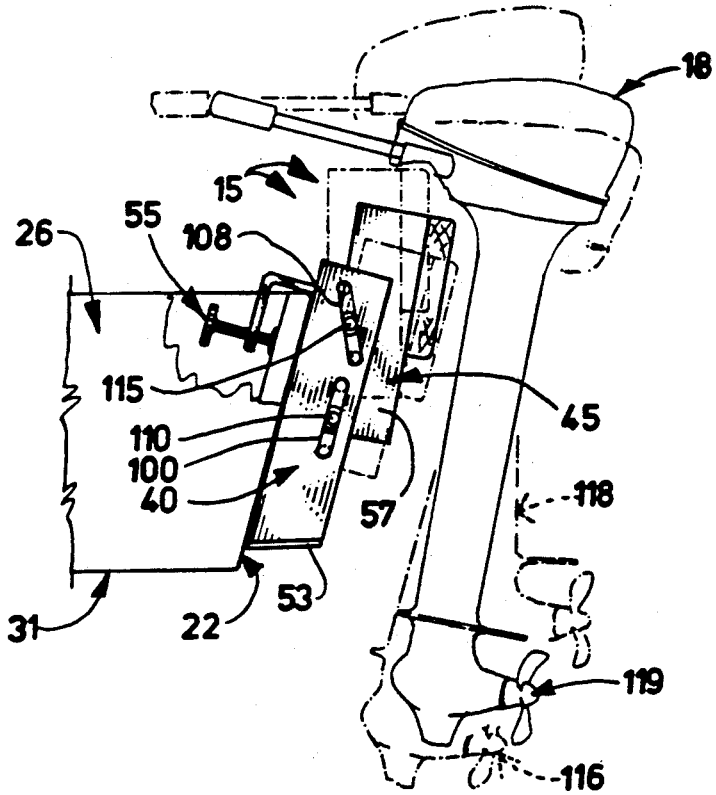
FIG. 2 is a side elevational view thereof, in which alternative dispositions of the jack and motor are shown in dashed lines, and in which portions are broken away for clarity.
Figure 4:
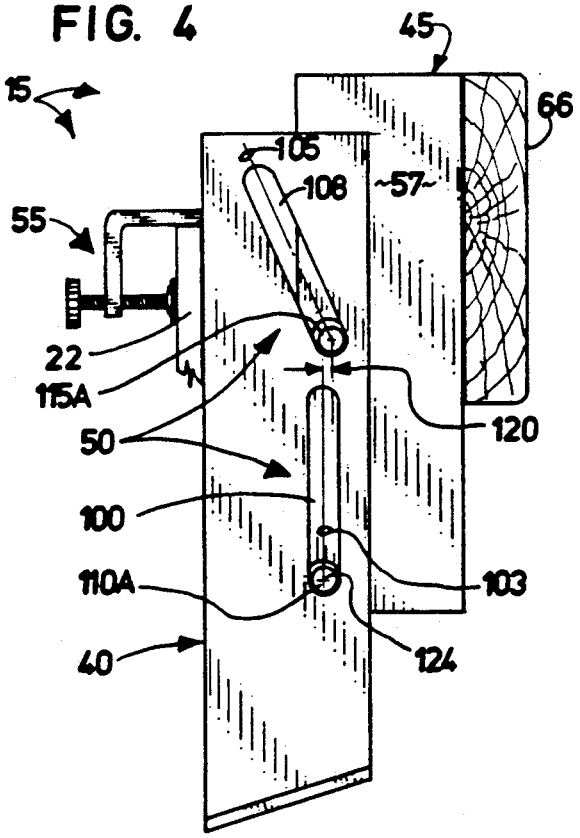
FIG. 4 is a side elevational view thereof.

With reference now directed to FIGS. 2–4, guide means 50 comprises cooperating pairs of upper and lower follower slots 108 and 100 respectively defined in the transom frame 40, and captivated followers 115 and 110 projecting from the motor bracket 45. The lower follower slots 100 are straight, and they have a longitudinal axis 103 (FIG. 4). Preferably the straight slots 100 and their respective axes 103 are oriented generally parallel to the boat transom when the plate 15 is properly mounted. Each of the second pair of follower slots 108 comprises a longitudinal axis 105 which is generally inclined relative to axis 103 of the straight slots. Preferably the inclined axis 105 is angled at approximately twenty to thirty-two degrees relative to the axis 103 of the straight follower slots. In the best mode, this angle of intersection is twenty-four degrees.

Follower slots 100 and 108 slidably receive followers 110 and 115 to define a path of travel for the motor bracket 45 to properly orient the motor prop and cavitation plate for optimum efficiency. Followers 110, 115 comprise rigid bolt assemblies which penetrate sides 48 of the motor bracket 45 and terminate in smooth rollers 110A, 115A. Rollers 110A, 115A slide within slots 100, 108 as the motor bracket is displaced in response to activation of the cylinder 80. The motor bracket and motor travel between a lowermost position generally indicated by the reference numeral 116 and an uppermost position 118, both illustrated in dashed lines in FIG. 2. The intermediate position generally designated by the reference numeral 119 is illustrated in solid lines in FIG. 2. It is preferably assumed for low-speed movement through shallow waters.

As vertical displacement of the motor occurs, the pivot point constantly shifts so that the motor bracket may assume various angular orientations. In the lower position the motor bracket 45 is oriented substantially parallel with the transom 22 and transom frame 40. As best viewed in FIG. 5, the retracted cylinder 80 is inclined relative to horizontal at an angle 83 of roughly positive five degrees when bracket 45 is lowest. The upper end 89 of the retracted cylinder projects outwardly beyond the transom frame, and the pivot braces 86 are oriented generally horizontally, roughly perpendicular to cylinder 80.

As best viewed in FIG. 4, the lower center of the inclined follower slot 108 (i.e. that portion occupied by roller 115A when in the lowest position) is offset from the lower center of the straight slot 100 by a distance 120. Offset 120 is provided to establish proper orientation of the motor as the motor bracket is raised upwardly and defines clearance, to prevent the motor bracket from contacting the boat transom 22 as it travels upwardly through the transom frame.

As the motor bracket moves upwardly, the cylinder 80 extends upwardly and rotates inwardly within bracket 82 toward the transom. Braces 86 pivot about cylinder 80 to smoothly urge the motor bracket into rotation as it is guided upwardly through the follower slots 100, 108. In the uppermost position, the motor bracket assumes an angle of approximately eighteen to twenty degrees relative to the transom frame. The fully extended cylinder shown in dashed lines in FIG. 5 and designated by the reference numeral 130 is inclined inwardly at an angle roughly negative five degrees relative to horizontal of transom frame 40.

2. Alternative Embodiment

Figure 8:
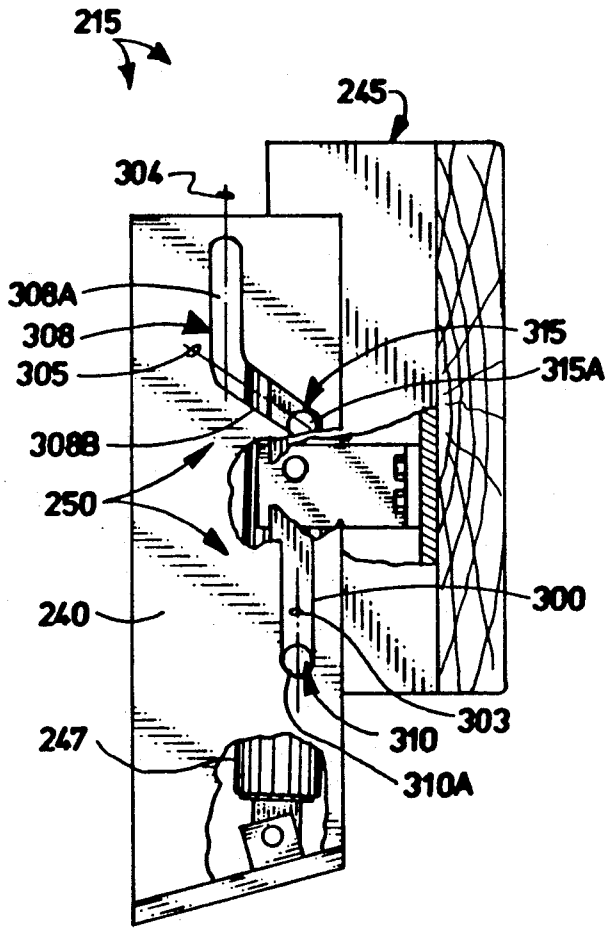
Figure 7:
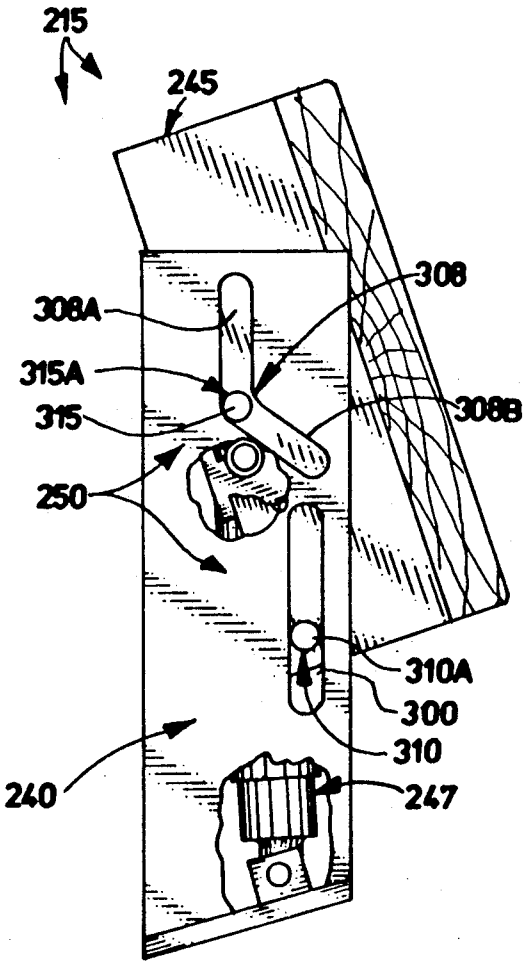
FIG. 7 is a side elevational view of the alternative embodiment of FIG. 6, illustrating the motor bracket disposed in an intermediate position, and in which portions are broken away for clarity; and, FIG. 8 is a side elevational view of the alternative embodiment of FIG. 6, illustrating the motor bracket disposed in the lowermost position, in which portions are broken away or shown in section for clarity.
Figure 6:
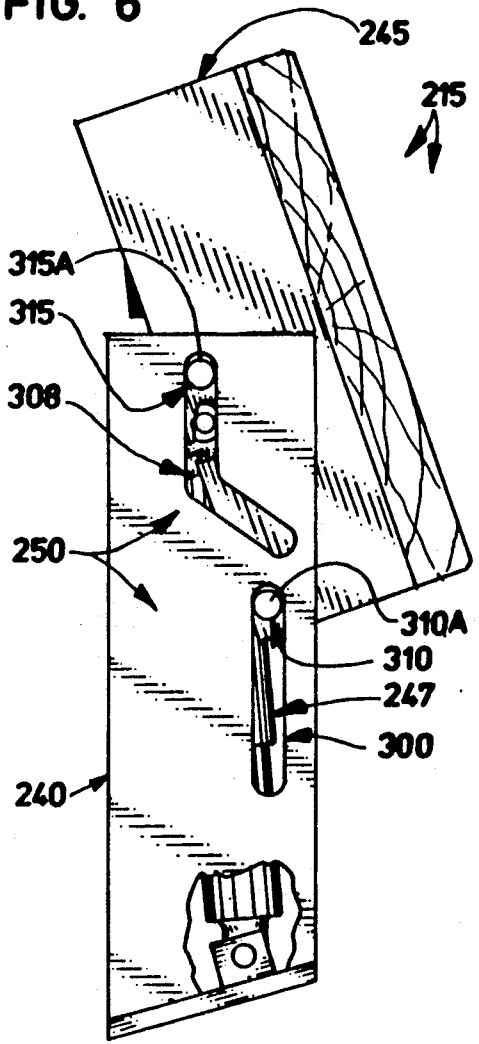
FIG. 6 is a side elevational view, illustrating an alternative embodiment, illustrating the motor bracket disposed in the uppermost position, and in which portions are broken away for clarity.

An alternative embodiment of our jack and trim transom plate invention is broadly designated by the reference numeral 215 in FIGS. 6–8. The plate 215 is in most respects identical to the best mode embodiment described above. The plate comprises a transom frame 240 and a motor bracket 245. Displacement of the motor bracket 245 within the transom frame 240 is effectuated by 4 actuator assembly designated by the reference numeral 247. Notably distinct from the best mode embodiment is the alternative guide means broadly designated by the reference numeral 250.

The alternative guide means 250 comprises cooperating pairs of follower slots 300 and 308 associated with the transom frame 240 and followers 310 and 315 associated with the motor bracket 245. A first pair of follower slots 300 comprises straight slots positioned on opposite frame walls. Slots 300 each define a generally vertical longitudinal axis 303. Preferably the straight slots 300 and their respective axes 303 are oriented generally parallel to the boat transom when the plate 15 is properly mounted.

Each of the second pair of follower slots 308 comprises an angular slot of generally L-shaped configuration comprising an upper angled arm 308A and a lower, straight arm 308B (FIGS. 7, 8). Slot arm 308A defines a longitudinal axis 304 which is generally parallel to the longitudinal axis 303 of the straight slot 300. Arm 308B defines a longitudinal axis 305 which is generally inclined relative to axis 303 of the straight slots. Follower slots 300 and 308 slidably receive followers 310 and 315 to define a path of travel for the motor bracket 245 to properly orient the motor prop and cavitation plate for optimum efficiency. Axis 305 preferably intercepts axis 304 at an angle of approximately fifty four degrees. As before an offset exists; the lowermost points within the slot portion 308B is offset from the lower slot 300.

Followers 310, 315 comprise rigid bolt assemblies which penetrate motor bracket 245 and terminate in smooth outer rollers 310A, 315A. Rollers 310A, 315A slide within slots 300, 308 as the motor bracket is displaced in response to activation of the cylinder 247. As the motor bracket moves vertically within the transom frame, the motor is guided first by lower slot arms 308B to an intermediate position of maximum angular orientation. At this point, the motor bracket assumes an angle of approximately eighteen to twenty degrees relative to the transom frame. After maximum angular displacement is achieved, the motor bracket continues upward movement guided vertically by rollers 310A, 315A through slot upper arms 308A and the straight follower slots 300. As the motor is raised upwardly past slot arms 308B, the orientation of the motor cavitation plate will vary only slightly so that maximum operating efficiency and comfort are assured.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A transom plate for dynamically mounting an outboard motor upon a fishing boat. said transom plate comprising:

transom frame means for securing said plate to the transom of said boat, said frame means comprising clamp means for securing said transom frame means to said boat, said frame means comprising a pair of rigid, spaced apart, generally parallel walls and a rigid base extending between said walls;

motor bracket means slidably coupled to said transom frame means for receiving said outboard motor, said motor bracket means comprising a clamping plate for attachment of said motor, said motor bracket means comprising a pair of rigid, spaced-apart, parallel sides operatively disposed between said transom frame walls;

actuator means for selectively moving said bracket means relative to said frame means, said actuator means comprising cylinder means pivotally interconnected between said transom frame means and said motor bracket means, and means for selectively activating or deactivating said cylinder means;

guide means for controlling the orientation of said motor bracket means relative to said transom frame means in response to relative displacements caused by said actuator means, said guide means comprising:

vertical follower slot means having a longitudinal axis generally parallel to the plane occupied by said boat transom for limiting displacement of said motor bracket means;

inclined follower slot means having at least a portion whose axis is inclined with respect to said vertical follower slot means for cooperating with said vertical follower slot means;

follower means riding within said vertical and inclined follower slot means for orienting said motor bracket means during movement thereof;

wherein said vertical follower slot means are defined in said frame walls and said inclined follower slot means are defined in said frame walls above said vertical follower slot means; and, whereby said transom plate effectuates simultaneous adjustment of motor height and trim in said motor.

2. The transom plate as defined in claim 1 including L-bracket means operatively disposed within said frame means for centering said actuator means within said transom plate.

3. The transom plate as defined in claim 2 wherein an axis of said inclined follower slot means intersects an axis of said vertical follower slot means at an angle of between twenty to thirty-two degrees.

4. A transom plate for dynamically mounting an outboard motor upon a fishing boat, said transom plate comprising:

transom frame means for securing said plate to the transom of said boat, said frame means comprising clamp means for securing said transom frame means to said boat, said frame means comprising a pair of rigid, spaced apart, generally parallel walls and a rigid base extending between said walls;

motor bracket means slidably coupled to said transom frame means for receiving said outboard motor, said motor bracket means comprising a clamping plate for attachment of said motor and a pair of rigid, spaced apart, parallel sides operatively disposed between said transom frame means walls;

actuator means for selectively moving said motor bracket means relative to said frame means, said actuator means comprising cylinder means pivotally interconnected between said transom frame means and said motor bracket means, and means for selectively activating or deactivating said cylinder means;

guide means for controlling the orientation of said motor bracket means relative to said transom frame means in response to relative displacements caused by said actuator means, said guide means comprising:

vertical follower slot means having a longitudinal axis generally parallel to the plane occupied by said boat transom for limiting displacement of said motor bracket means;

inclined follower slot means having at least a portion whose axis is inclined with respect to said vertical follower slot means for cooperating with said vertical follower slot means;

follower means riding within said vertical and inclined follower slot means for orienting said motor bracket means during movement thereof;

wherein said inclined follower slot means are generally L-shaped, comprising a first arm and a second arm, said first arm generally inclined relative to said vertical follower slot means and said second arm extending generally parallel to said vertical follower slot means, wherein an axis of said first arm intersects an axis of said vertical follower slot means at an angle of approximately fifty four degrees; and, L-bracket means operatively disposed within said frame means for centering said actuator means within said transom plate whereby said transom plate effectuates simultaneous adjustment of motor height and trim in said motor.

5. A transom plate for operatively mounting an outboard motor upon a fishing boat, said transom plate comprising:

transom frame means for mounting said plate to the transom of said boat, said frame means comprising a pair of rigid, spaced apart, generally parallel walls, a rigid base extending between said walls, and clamp means for securing said transom frame means to said boat;

motor bracket means slidably coupled to said transom frame means for receiving said outboard motor, said motor bracket means comprising a pair of rigid, spaced-apart, parallel sides operatively disposed parallel with said transom frame walls, and a rigid clamping plate extending between said sides for attachment of said motor;

cylinder means for moving said bracket means relative to said frame means, said cylinder means disposed within said transom plate and pivotally interconnected to both said transom frame means and said motor bracket means;

a vertical follower slot having a longitudinal axis generally parallel to the plane occupied by said boat transom defined in each of said frame means walls;

an inclined follower slot having at least a portion whose axis is inclined with respect to said vertical follower slot longitudinal axis and defined in each of said frame walls;

follower means for penetrating both said vertical and said inclined follower slots for slidably coupling said motor bracket means to said transom frame means;

wherein said follower slots define a path for movement of said motor bracket means relative to said transom frame means for effectuating simultaneous adjustment of trim and vertical displacement in said motor, and the origin of said inclined follower slot is offset from the origin of said vertical follower slot; and, wherein said inclined follower slots comprises a generally L-shaped configuration having a first arm and a second arm, said first arm generally inclined relative to said vertical follower slot and said second arm extending generally parallel to said vertical follower slot and the plane established by the boat transom.

6. The transom plate as defined in claim 5 wherein the inclined portion of said inclined follower slot is angled at approximately 54 degrees relative to said vertical follower slot.

7. The transom plate as defined in claim 5 wherein the inclined portion of said inclined follower slot is angled at approximately 54 degrees relative to said vertical follower slot, whereby said motor bracket means is substantially parallel with said frame means when said motor bracket means is disposed in its lowermost position, and during jacking it moves to approximately 18–20 degrees as it reaches its uppermost position.

* * * * *